United States Patent [19]

Leo

[11] 4,291,547

[45] Sep. 29, 1981

[54] SCREW COMPRESSOR-EXPANDER CRYOGENIC SYSTEM

[75] Inventor: Bruno S. Leo, Santa Monica, Calif.

[73] Assignee: Hughes Aircraft Company, Del.

[21] Appl. No.: 158,764

[22] Filed: Jun. 12, 1980

Related U.S. Application Data

[63] Continuation-in-part of Ser. No. 894,677, Apr. 10, 1978, abandoned.

[51] Int. Cl.[3] ..... F25D 9/00

[52] U.S. Cl. ..... 62/402; 418/9; 418/86; 418/200; 62/505

[58] Field of Search ..... 62/402, 86, 505, 510; 418/9, 200, 201, 86

[56] References Cited

U.S. PATENT DOCUMENTS

| | | | |
|---|---|---|---|
| 2,804,260 | 8/1956 | Nilsson et al. | 418/201 |
| 3,405,604 | 10/1968 | Lysholm | 418/86 |
| 3,751,673 | 8/1973 | Sprankle | 418/201 |
| 3,795,117 | 3/1974 | Moody, Jr. et al. | 62/505 |
| 3,902,827 | 9/1975 | Schibbye | 418/201 |
| 3,910,731 | 10/1975 | Perrson et al. | 418/201 |
| 3,956,904 | 5/1976 | Edwards | 62/402 |

FOREIGN PATENT DOCUMENTS

| | | | |
|---|---|---|---|
| 609405 | 1/1935 | Fed. Rep. of Germany | 418/201 |

*Primary Examiner*—Ronald C. Capossela

*Attorney, Agent, or Firm*—Allen A. Dicke, Jr.; W. H. MacAllister

[57] ABSTRACT

Cryogenic refrigeration system employs a power driven screw compressor which delivers pressurized refrigerant gas through a closed system to expand in a screw expander to produce refrigeration. The screw expander is rotatively coupled to the compressor. The screw compressor-screw expander cryogenic system includes heat exchangers and operates on the closed Brayton cycle to produce refrigeration.

30 Claims, 7 Drawing Figures

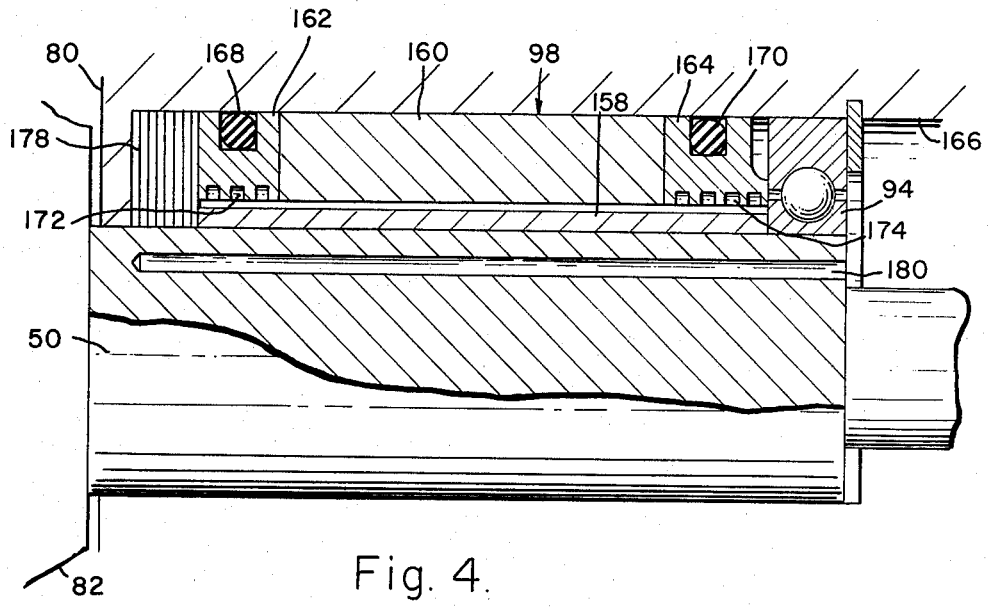
Fig. 4.
Fig. 7.
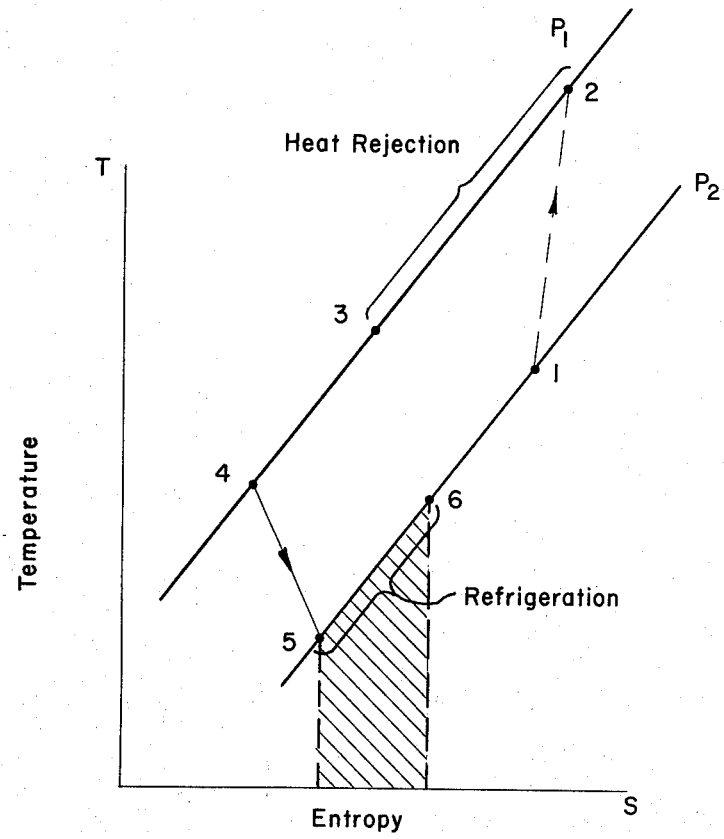

SCREW COMPRESSOR-EXPANDER CRYOGENIC SYSTEM

CROSS-REFERENCE

This application is a continuation-in-part of patent application Ser. No. 894,677 filed Apr. 10, 1978, now abandoned.

BACKGROUND OF THE INVENTION

This invention is directed to a cryogenic system wherein both the compressor and expander, which operate with the cryogenic refrigerant fluid in the system, are rotary screw type machinery of the Lysholm type.

Lysholm build an early prototype of the rotary screw compressor in 1934. Some of his development work was described in the *Proceedings of the Institution of Mechanical Engineers,* Vol. 150, No. 1, Pages 11–16 and 4 plates 1943. One of the main features of this screw compressor is the fact that it can run without oil or other lubricant in the compression chamber. No oil is necessary because the rotors do not contact each other or the casing. The only mechanical contact is in the bearings and in the timing gears which can be located on the outside of the casing and away from the refrigerant gas flow stream. The Lysholm type rotary screw compressor has two rotors with intermeshing lobes. Within the intermesh of the lobes and housing, the compression takes place. Two helical rotors comprise the working parts of the screw compressor. The male rotor generally has four lobes and rotates 50 percent faster than the female rotor which has six flutes between which are grooves in which the lobes interengage. Other ratios of lobes to flutes are also used. The gas is compressed in the spaces between the housing, the lobes and the grooves. The lobes and the grooves are helical so that the space appears to move progressively toward the outlet end of the housing, and the space becomes progressively smaller along the length of the rotors as the rotors rotate. Thus, gas taken in the inlet port at the suction end is compressed in the space as the rotors turn and it is finally delivered at higher pressure from the outlet port at the delivery end of the housing. The inlet and outlet ports are automatically covered and uncovered by the sharped ends of the rotors as they turn.

There have been considerable development work done on the improvement of such screw compressors. Most of the patents are owned by Svenska Rotor Maskiner which devoted the pioneer effort in this art and appears to hold most of the patents. The company is located in Nacka, Sweden.

Nilsson, U.S. Pat. No. 3,245,612 and Schibbye, U.S. Pat. Nos. 3,283,996 and 3,423,017 are particularly directed to the shapes of the lands and the grooves in the rotors, but show the porting and general organization of the rotary screw compressor to show how compression and expansion are achieved in such a structure. Furthermore, this type of screw compressor is illustrated as being the compressor in refrigerator systems in U.S. Pat. Nos. 3,432,089; 3,811,291; 3,848,422 and 3,945,216. While the use of screw compressors has been recognized for refrigerator compressor service, the use of such devices as expanders has not been recognized. Furthermore it has not been previously recognized that screw compressors and expanders in the same refrigerator can efficiently run at about the same speed so that they can be coupled directly or through gearing, for speed control of the expander and for power feedback from the expander. In the refrigeration arts, it is known that it is necessary to extract work during expansion to produce refrigeration, with some refrigerant gases within some of their operating temperature ranges. In the past, piston expanders have been used, usually in smaller refrigerators, and turbo expanders have been used, usually in larger refrigerators. While the work output of such expanders is not significant in terms of total refrigerator input power, speed control of the expander is necessary. Such speed control has been difficult where the turto expander runs at very high speed. It is part of this invention that the employment of an expander coupled to and running with the compressor is feasible when screw-type equipment is used for refrigerant gas compression and expansion. This arrangement has not previously been used in refrigerators and results in equipment which is of considerably longer life so that it can be employed in locations where maintenance is impractical. Furthermore the system is of low weight to unit of refrigeration in modest sizes, and is of low power requirement per unit of refrigeration in the same modest sizes. Therefore, such a refrigerator system can be used to cool devices for a long maintenance-free life, and can be employed in locations where total weight and input power should be minimized.

SUMMARY OF THE INVENTION

In order to aid in the understanding of this invention, it can be stated in essentially summary form that it is directed to a screw compressor-expander refrigeration system wherein a screw compressor compresses a refrigerant gas, which is cooled by heat exchange and delivered to a screw expander which expands the refrigerant gas for the cooling thereof, with the expander being coupled to the compressor to feed work to the compressor and regulate expander speed, so that refrigeration is achieved.

It is thus an object of this invention to provide a screw compressor-expander cryogenic system wherein Lysholm-type gas handling equipment is used for compression and expansion of the gas to produce refrigeration. It is another object of this invention to provide a refrigerator wherein a long trouble-free life is achieved. It is a further object to provide a screw compressor-expander cryogenic refrigerator system wherein the expander runs at the same relative rotative rate as the compressor to permit coupling between the expander and compressor for speed control of the expander and feedback of work from the expander to the compressor. It is another object to provide a screw compressor-expander cryogenic refrigerator system wherein the employment of a screw-type compressor and a screw-type expander permits the production of refrigeration at an increased value of unit of refrigeration per unit of weight so that the system can be employed in locations where weight is critical. It is a further object to provide a cryogenic refrigerator system which employs a screw-type compressor and a screw-type expander wherein more refrigeration is produced per unit of input power to permit use of the refrigerator system in locations where power must be conserved.

Other objects and advantages of this invention will become apparent from a study of the following portion of the specification, the claims and the attached drawings.

BRIEF DESCRIPTION OF THE DRAWINGS

FIG. 4 is an enlarged detail of the seal structure, with parts broken away and parts taken in section.

FIG. 7 is a temperature-entropy diagram showing the operating conditions of the cryogenic system.

DESCRIPTION OF THE PREFERRED EMBODIMENT

Figure 1:
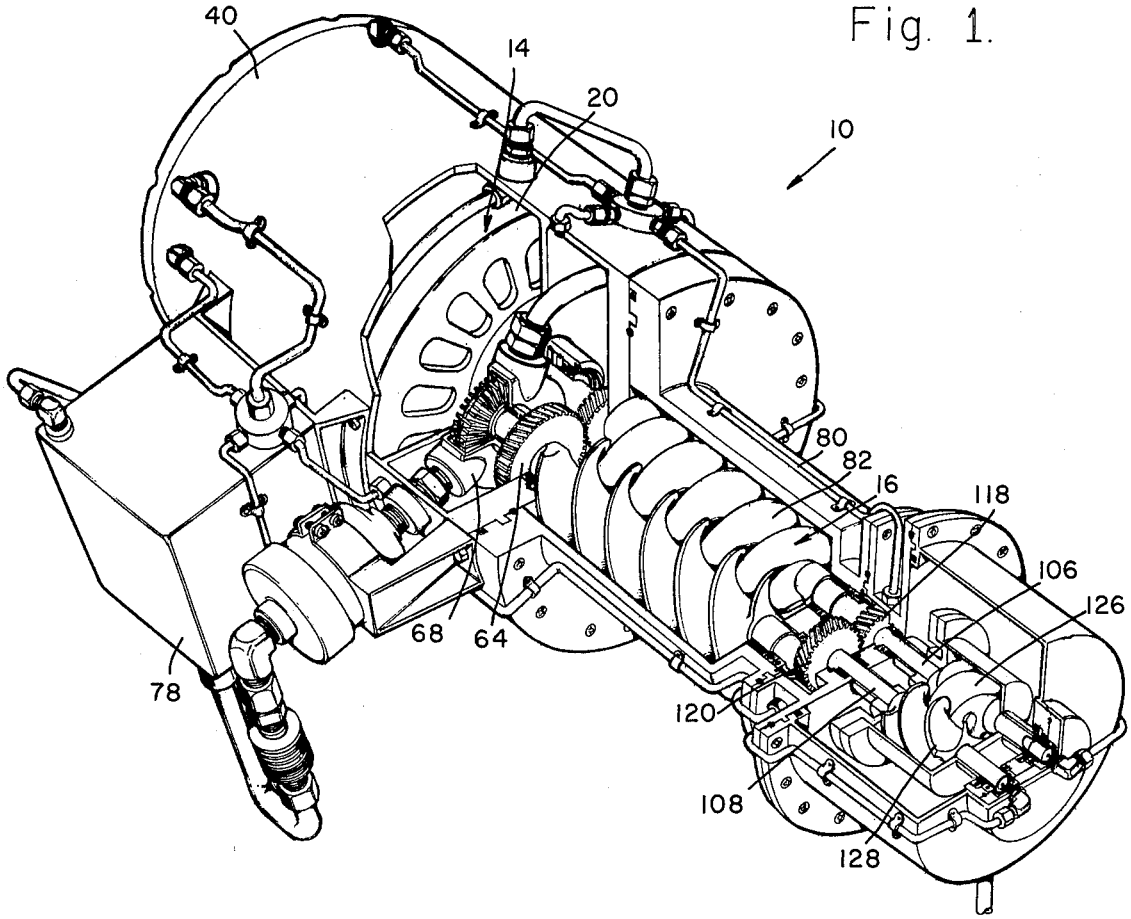
FIG. 1 is a perspective view of the screw compressor-expander structure, with parts broken away to show a portion of the internal mechanism.

Referring particularly to FIGS. 1, 2, 3, and 6, a screw compressor-expander mechanism is generally indicated at 10. The mechanism 10 is used in conjunction with an external refrigerant circuit 12, see FIG. 6, to result in the screw compressor-expander cryogenic system of this invention. The mechanism 10 broadly comprises a motor 14 which drives a compressor 16 and which is also coupled to an expander 18.

Figure 6:
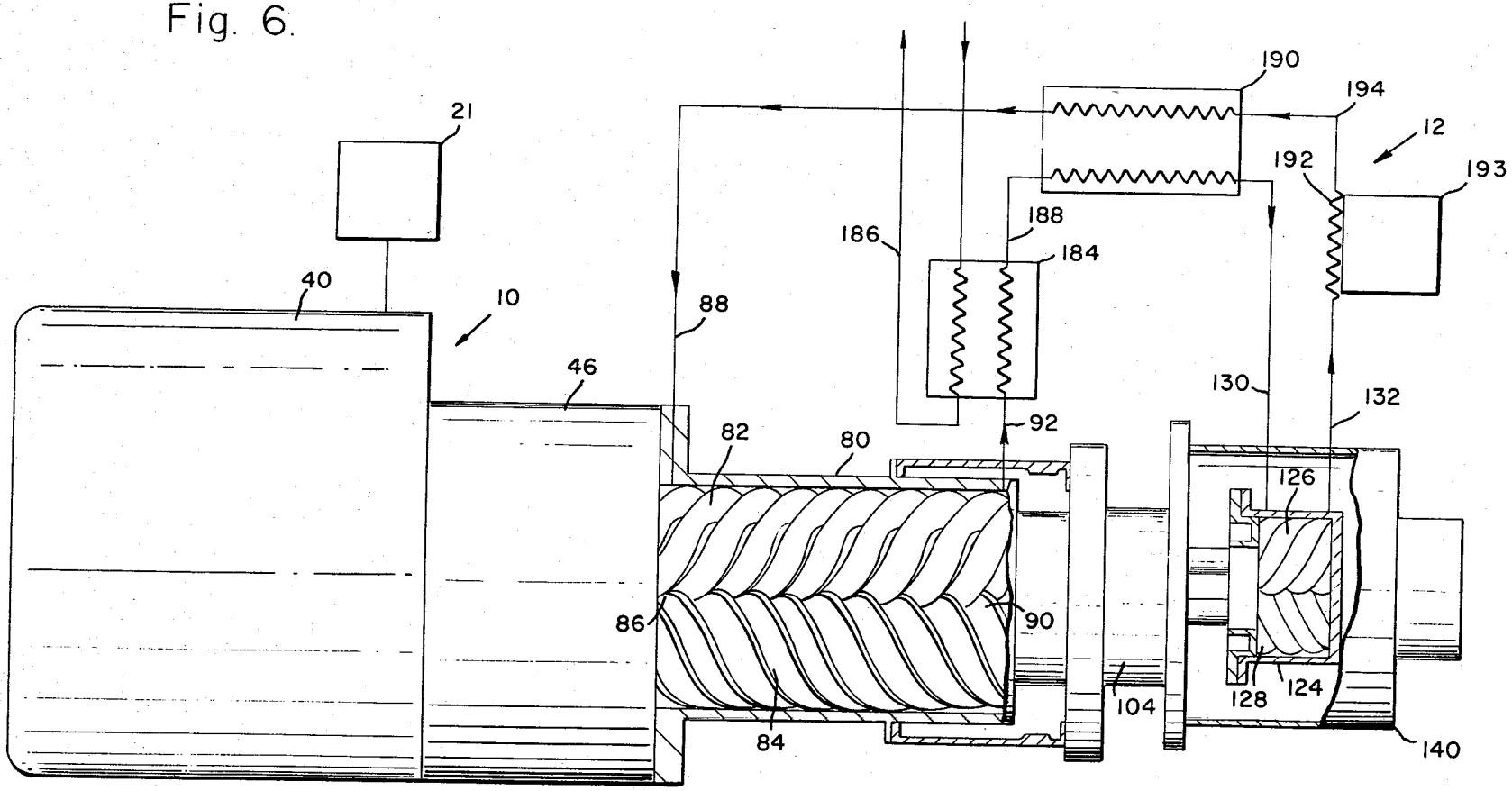
FIG. 6 is a plan view, with parts broken away and parts taken in section of the screw compressor-expander structure, shown in conjunction with its associated system components so that the cryogenic refrigeration system is shown.

The motor 14 comprises a motor housing 20 within which is mounted the electrical windings and the rotor of the motor 14. FIG. 6 shows a power supply 21 connected to the motor 14 for supplying the requisite electric power thereto. The power supply 21 may include a source, such as a solar array, and a power conditioning system when the refrigerator 10 is deployed in space. Power supply 21 may be a more conventional power line, generator or battery when the refrigerator 10 is used on ground, air, or shipboard equipment. A shaft 22 extends from the housing 20 on its right end. The shaft 22 is mounted on a pair of antifriction bearings 24 and 26, on the ends thereof, for the rotary support of the rotary portions of the motor. The ball bearings 24 and 26 are mounted in a pair of respective bosses 28 and 30, and the bosses are mounted on the motor housing. A cover 32 encloses the exterior of the bearing 24 and the boss 28. An oil inlet connection 34 furnishes oil to the bearing 24 while an oil outlet connection 36 returns the oil from the interior of the cover 32 for recirculation. A seal 38 prevents the entrance of oil from the region of the bearing 24 into the interior of the motor housing 20. A cover 40 protects the exterior of the motor housing and the bearing assembly of which the bearing 24 is a part. An oil tube 42 may be wrapped around the motor housing 20, or oil passages may be provided within the exterior structure of the motor housing 20 to provide for coolant flow to carry away the heat of the motor 14. Oil tube 42 is part of the general lubrication system of the mechanism 10, and it may be the tube which supplies the oil inlet connection 34. Cover 40 protects the exterior of the motor housing 20, the cooling oil tube 42, and the bearing structure under the cover 32.

The shaft 22 extends out of the boss 30 and beyond the bearing 26 and has an interior spline 44. A housing 46 surrounds the boss 30 and has an interior boss 48 therein. The boss 48 has a shaft 50 therein in alignment with shaft 22 and a shaft 52 therein oriented in parallel to the shaft 50. The shafts 50 and 52 are respectively supported on a bearing 54 and a bearing 56. A seal 58 is located around the shaft 50 interiorly and adjacent to the bearing 54 while a seal 60 is positioned around the shaft 52 and adjacent the bearing 56.

A timing gear 62 is mounted on the shaft 50 while a timing gear 64 is mounted on the shaft 52. The timing gear 62 is the drive gear and it engages the timing gear 64 which is the driven gear. The shaft 50 has an exterior spline 66 adjacent the gear 62 and extending into and engaging the spline 44. By this construction, with rotation of the motor shaft 22, the shafts 50 and 52 also rotate. Oil is supplied within the housing 46 to lubricate the bearings 26, 54 and 56. The oil also lubricates the spline coupling defined by the splines 44 and 66, as well as lubricates the mesh of the gears 62 and 64. Furthermore, the housing 46 serves as the oil sump and interiorly thereof is located the oil pump 68 which takes suction through an appropriate suction line 70 from the oil within the sump. The suction line 70 and the oil pump 68 are specifically designed to pump in accordance with the local ambient conditions. In normal gravitational environments, the suction may be a filter in the bottom of the sump (from a gravitational viewpoint) while in nongravitational or very low g requirement, the pump suction may be especially designed to pick up globules of oil floating free within the housing, and/or the suction may pick up oil which is moving by surface tension on the inside of the walls of the housing 46. In another manner of operation the housing 46 may be completely filled with oil so the pump 68 operates like in gravitational conditions. The oil pump 68 delivers oil to the various needs of the mechanism 10, including the lubrication of the bearing 24 and the cooling of the motor 20. There are other lubricant requirements in the mechanism 10, described hereinafter, and these are also supplied by the pump 68. A connection 74 and a connection 76 are through flow connections for the housing 46. The oil discharge from the pump 68 may be cooled as in a cooler 78 illustrated in FIG. 1. The various connections illustrated on the cooler 78 illustrate connections for the utilization of oil from the cooler.

A compressor housing 80 houses a lobed screw compressor rotor 82 on shaft 50 and a mating recessed rotor 84 on the shaft 52. The rotors 82 and 84 closely interfit with each other, and closely interfit with the casing 80 both radially and at the ends. The housing 80 has an opening on the side of the housing 80 adjacent the intermesh of the rotors at one end thereof to define an inlet zone 86 to which is connected a suction line 88, see FIG. 6. At the other end of the housing 80, also at the intermesh between the rotors 82 and 84 is an outlet zone 90 to which is connected an outlet line 92.

The right hand ends of the shafts 50 and 52 are rotatably supported in a set of anti-friction bearings 94 and 96 respectively which are in turn protected by seals 98 and 100 respectively. The inlet and outlet ports in association with the inlet and outlet zones 86 and 90 are disclosed in several of the patents discussed in the background. The shapes of the rotors 82 and 84, in connection with the inlet and outlet ports and the compressor housing 80 are such that compression is achieved in the space between the rotors and the end of the housing 80. As the rotors rotate, individual spaces defined by the lobes and recesses of the rotors appear to proceed along in the housing. In the present case, rotation is such that the procession appears to be from left to right. As the inlet port in the left end of the housing 80 is cut off, the volume of the space appears to decrease so that compression takes place. When compression reaches the desired value, then the outlet port is uncovered to discharge the compressed gas to the outlet line 92.

A cooling chamber 102 may embrace the high pressure end of the compressor housing 80 to remove some of the heat of compression, if required to maintain reasonable temperature gradients and limits in the housing, rotors and appurtenant structure. The cooling chamber 102 may be supplied with circulating oil as a coolant, or may employ another coolant, as desired.

A housing 104 is flanged to the right end of the compressor housing 80. The housing 104 contains a pair of expander shafts 106 and 108 which are mounted on a pair of bearings 110 and 112 and which are sealed by a pair of seals 114 and 116. A pair of timing gears 118 and 120 are respectively mounted on the shafts 106 and 108. The timing gears interengage to maintain the shafts at particular interrelated angular positions and angular rate ratios. The shaft 106 is coupled to the shaft 50 by means of spline coupling 122 so that the shaft 106 turns with the shaft 50, and the shaft 108 turns with the shaft 106.

While the preferred embodiment incorporates the direct coupling between the expander 18 and the compressor 16, as exemplified by the spline coupling 122, it can also be appreciated that other relationships are possible. For example, the expander can be placed close to the refrigeration load while the compressor 16 may be located conveniently to the source of power and/or a location where the heat of compression can be rejected. In such a case, ambient refrigeration gas is piped to and from the compressor to the location of the expander 18. The cryogenic heat exchanger between inlet and outlet expander gas would be located close to the expander. In the case where the expander is remotely located, speed control of the expander would be achieved by a separate motor/generator directly or gear coupled to the expander shaft 106. Furthermore, in such an arrangement the expander can run at a higher speed than the compressor. A higher speed is feasible because the expander 18 is smaller in physical size than the compressor 16.

The shafts 106 and 108 are tubular and extend into an expander housing 124. A lobed rotor 126 is mounted on the shaft 106 while a rotor 128 having mating recesses thereon is mounted on the shaft 108. The lobes and recesses of the rotors 126 and 128 intermate and define spaces which act to expand gas. They are of the same nature as the compressor rotors in that the expansion takes place in the spaces between the housing 124 and the rotors 126 and 128. The criteria for the construction of this expander is the same as for the Lysholm type compressors discussed above, except that the structure runs in the opposite direction. As seen in FIG. 6, an inlet line 130 is connected to the inlet port of the expander 18 while an outlet line 132 is connected to the outlet port of expander 18.

Figure 5:
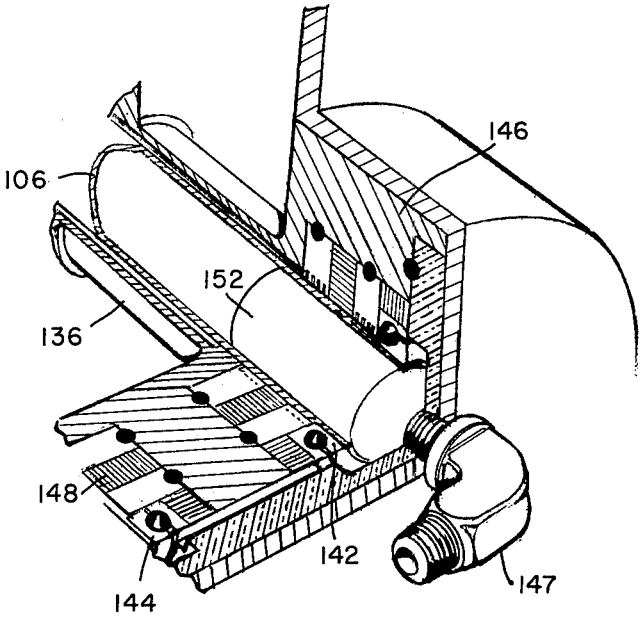
FIG. 5 is a perspective view with parts broken away and parts taken in section of the bearing and seal structure at the end of the expander shaft.
Figure 2:
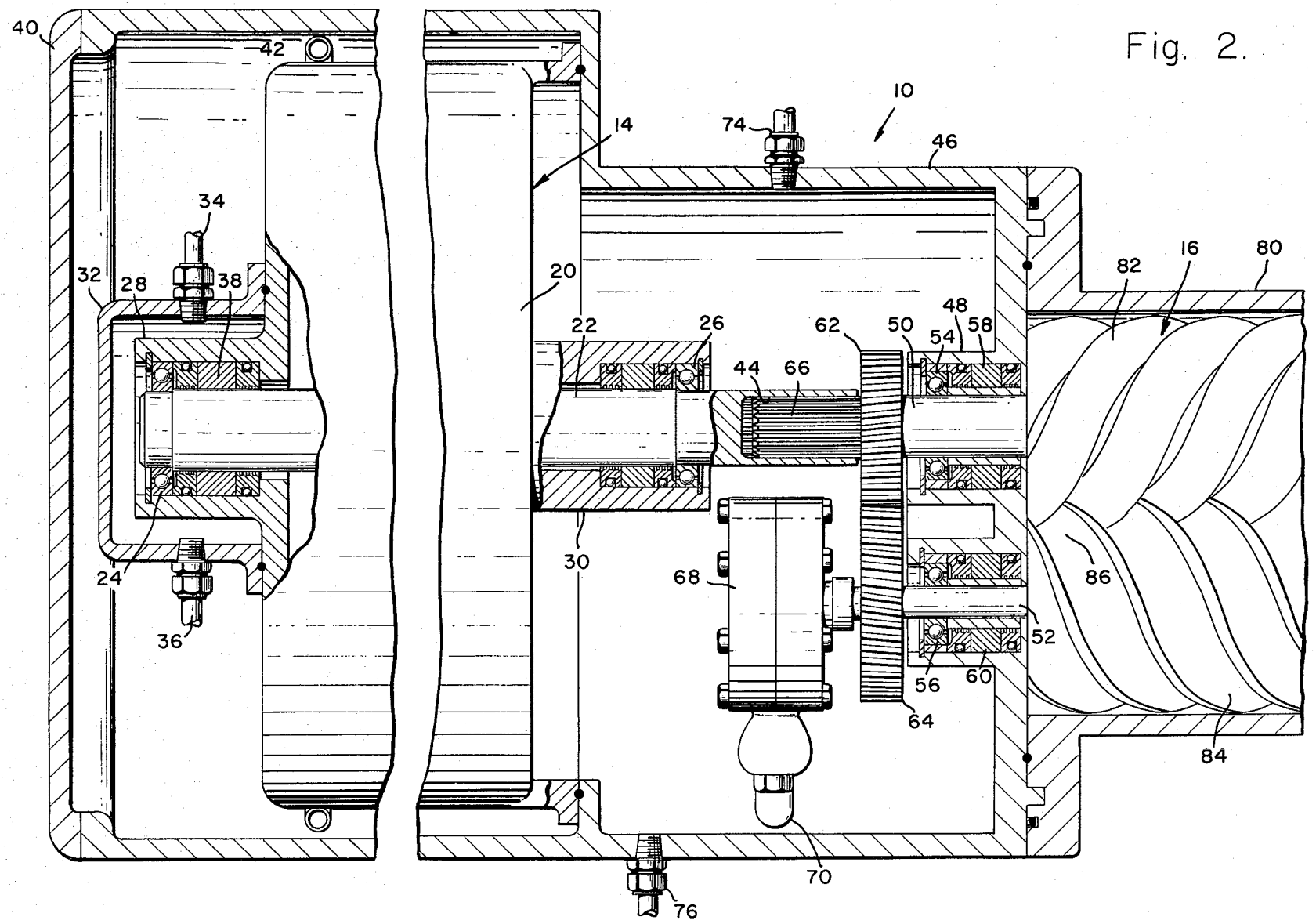
FIGS. 2 and 3, when taken together, comprise a longitudinal section through the screw compressor-expander mechanism, with some parts broken away and some parts taken in section.
Figure 3:
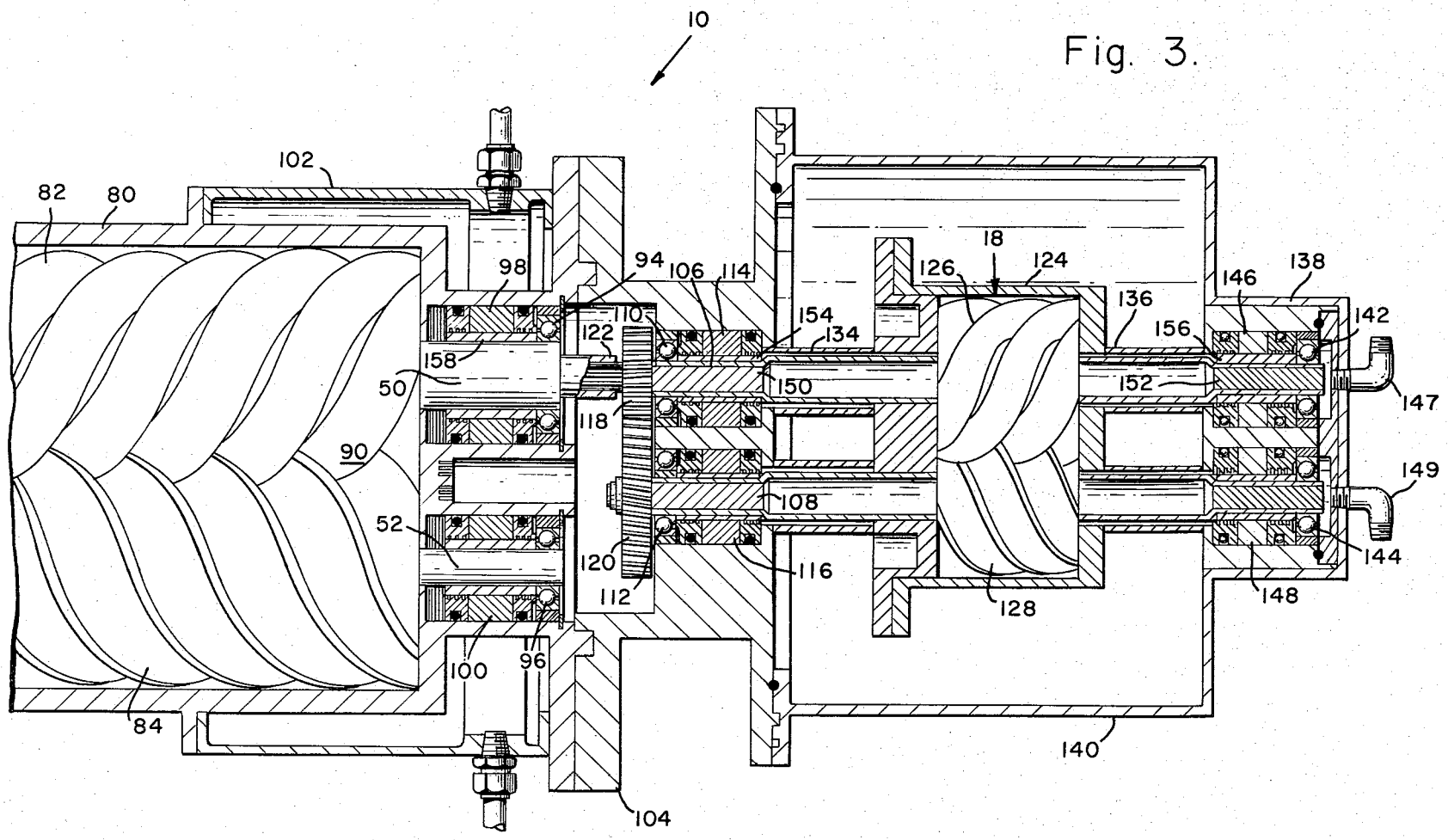

The expander housing 124 is mounted on tubular supports, such as a tubular support 134 seen in FIG. 3 which is mounted on the housing 104. The support 134 is in supporting engagement with the expander housing 124. A tubular support 136 extends between the expander housing 124 and a bearing housing 138. A dewar housing 140 encloses the expander 18 and mounts on the housing 124. The dewar housing 140 insulates the expander 18 which operates at cryogenic temperatures. Furthermore, bearing housing 130 is mounted on the outer end of the dewar housing 140. The hollow shafts 106 and 108 extend through the rotors and are rotatably supported in the bearing housing 138 in a pair of bearings 142 and 144, see FIGS. 3 and 5. The bearings 142 and 144 are respectively protected by a seal 146 and a seal 148. Lubricant is supplied and drained from the bearings 142 and 144 by means of an oil inlet 147 and an oil outlet 149. These provisions for oiling permit the circulation of oil from the oil pump 68 through the bearing area and out therefrom. Since the expander 18 is cold, the oil may supply heat to the bearings 142 and 144 to keep them temperature stabilized.

The shafts 106 and 108 are hollowed tubes to limit heat transfer to the physical structure of the expander from the region of the bearings. However, in order to keep the seals 114, 116, 146, and 148 as well as the bearings 110, 112, 142, and 144 temperature stabilized, thermal plugs are fitted into the shafts at the ends inside the bearings and the seals. A thermal plug 150 is illustrated as being within the shaft 106 interiorly of the bearing 110 and the seal 114, while a thermal plug 152 is illustrated as being in the interior of the tubular end of the shaft 106 interiorly of the bearing 142 and the seal 146. In addition, a sleeve 154 is fitted exteriorly of the shaft 106 within the seal 114 while a sleeve 156 is fitted exteriorly of the shaft 106 interiorly of seal 146. These sleeves are fitted throughout, within the seals, as for example the sleeve 158 fitted exteriorly of the shaft 50 within the seal 98.

FIG. 4 illustrates the seal 98 in more detail. The shaft 50 has the sleeve 158 positioned on its exterior. The sleeve 158 is of magnetizable material and acts as a pole-piece, and is necessary when the shaft 50 is of non-magnetic material. In cases where the shaft 50 is of magnetizable material, the sleeve 158 is not required. A bushing 160 in the form of a tubular cylinder which is axially magnetized is provided around the sleeve 158. The bushing 160 is a permanent magnet but a solenoid coil could be substituted. A magnetic pole piece 162 is positioned at one end of the magnetic bushing 160 and a magnetic pole piece 164 is positioned at the other end of the magnet bushing 160. The pole pieces are in the form of rings and are sealed within a bore 166 in the housing 80 by means of an O-ring 168 and an O-ring 170 respectively. The pole pieces 162 and 164 have annular grooves therein such as a groove 172 in the pole piece 162 and a groove 174 in the pole piece 164. These grooves concentrate the magnetic field in the radial space between the pole pieces and the sleeve 158. The lubricant supplied to the bearing 94 is of oily-type material. It may be of hydrocarbon base or silicone base, so that it supplies the lubricant at an accepable viscosity over the operating range of the mechanism 10. Furthermore, very finely divided magnetizable iron particles are present in the lubricant supply. These iron particles are sufficiently small to pass through any filters in the lubrication system and are small enough that they do not reduce the life of the anti-friction bearings. The lubricant can circulate through the bearings, as through the bearing 94 and reach the annular space between the pole piece 164 and the sleeve 158. A magnetizable particle diameter in the range of 50 to 100 Angstroms is satisfactory in this work. There is sufficient magnetizable material such as iron powder in the oil lubricant so that when the iron is trapped between the pole pieces 162 and 164 and the sleeve 158, no oil passes. Thus, this provides a non-contacting long life seal. A hard packing 178 is provided between the sleeve 158 and the end of the bore 166 to minimize heat transfer from the compressed gas to the seal area.

A plurality of axially oriented cooling holes are drilled into the shaft 50 from the end underneath the bearing, all the way underneath the seal. A hole 180 is shown in FIG. 4, and is exemplary of several such holes drilled parallel to the axis, and positioned off axis just under sleeve 158. These cooling holes permit the circulation of oil into the region beneath the seal 98 to carry heat away from the seal area to maintain seal temperatures.

Referring to FIGS. 6 and 7, the cycle parameters are described. The system operates in an environment in which the mechanism 10 is generally at about 300° K., when in equilibrium with the ambient. In a specific cycle example, the compressor suction line 88 is at 299° K. and ½ atmosphere absolute. See point 1 in FIG. 7. The refrigerant gas is nitrogen in the present operating cycle example, but may be nitrogen, argon, helium or neon depending on the desired refrigeration temperature. The screw compressor 16 is driven by the motor 14 with the lobed rotor 82 running about 10,000 RPM. In this example the rotor 82 has 4 lobes while the rotor 84 has 5 recesses. The screw compressor 16 is such as to raise the pressure in the outlet line 92 to 1 atmosphere at point 2 in FIG. 7. A heat exchanger 184 rejects heat to the ambient, as by fluid circulating in the circulating line 186. The circulating line 186 may carry a liquid or a gas, or in space applications may directly radiate heat to space. In the heat exchanger 184, heat is rejected from the refrigerant gas so that in the line 188 the conditions are as at point 3 in FIG. 7. Temperature is at 300° K.

A heat exchanger 190 is a counterflow heat exchanger with heat exchange between the fluid in line 188 and the refrigerant fluid flowing to the compressor in suction line 88. In the heat exchanger 190, the refrigerant gas is cooled from point 3 to point 4 in the TS diagram of FIG. 7. The fluid flows from the heat exchanger into expander inlet line 130. At that point, the refrigerant gas is at 185° K.

The expander 18 in the present example is running at the same speed as the compressor, because the lobed rotor 126 thereof is running at the same speed as the lobed rotor 82 of the compressor 16. It is understood that if desired, a gear box may be employed within the housing 104 so that the expander may run at a different speed. However, the present preferred embodiment is to have the two shafts run at the same speed, in view of the mechanical simplicity. There is not believed to be a sufficient thermodynamic advantage to operate at a different speed to warrant the additional complexity caused by the gear connection. In either a direct drive situation as illustrted in FIG. 3, or in a gear drive, the expander rotors are coupled to the compressor rotors which in turn are controlled in speed by the drive motor 14. This has the effect of controlling the speed of the expander 18 as well as feeding back to the compressor power resulting from the gas expansion. In the expander, the refrigerant gas is expanded to the suction pressure of one half atmosphere and to 177° K., at point 5. This is the condition in the outlet line 132. In same conditions, the refrigerant may be a mixed vapor-liquid fluid at the expander outlet. The screw expander 10 can handle such a mixed fluid without damage. A refrigeration load 192 supplies heat to the refrigerant gas. It is here that the useful refrigeration is achieved. A refrigerator heat load 193 is illustrated in FIG. 6 as delivering heat at below ambient temperatures to the refrigeration load heat exchanger 192. The refrigeration load 193 is equipment which requires a subambient temperature for proper operation. It may be an electronic device such as a cooled amplifier. It may be a sensor such as an infrared sensor which requires cooling to reduce background electronic noise signals. It may even be a compartment in which materials can be stored or treated while at subambient temperatures. The refrigeration temperature is about 180° K, with 177° K., gas going into the refrigeration load and 184° K. gas coming out of the refrigeration load in a line 194. The conditions in line 194 are represented at point 6 in FIG. 7 and represent the cold input to the heat exchanger 190. Fluid in the line 194 passes through the heat exchange 190 to the line 88 and exchanges heat therein. This closes the cycle. The above are calculated values.

The dewar housing 140 is insulated in order to maintain the expander 18 in a cool condition, with a minimum amount of heat conducted and radiated into the expander. The refrigeration heat load 192 is schematically shown exteriorly to the dewar 140 in FIG. 6, but may be interiorly thereof, as an infrared radiation detector, or other refrigeration load.

The mass flow rate of the system upon the gas, the amount of cooling desired and the refrigeration temperature. The compressor rotor 82 and the expander rotor 126 are sized to handle the mass flow rate. The working pressure increase in the compressor is one half atmosphere. In a medium size machine, the compressor rotor 82 runs at 10,000 RPM.

Compared to Stirling cycle machines and Vuilleumeir machines, the present system has a favorable specific power consumption and has a better chance to reach maintenance-free life of up to ten years, and accordingly is particularly useful.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A closed cycle cryogenic refrigeration system comprising:

a screw compressor having a housing having inlet and outlet ends, an inlet and an outlet adjacent the ends of said housing;

first and second rotors rotatably mounted within said housing, said first and second rotors respectively having intermeshing lobes and recesses configured and fitted so that compression without oil occurs in oil-free gas passing through said compressor;

an expander having an expander housing having inlet and outlet ends, an inlet adjacent one end of said expander housing and an outlet adjacent the other end of said expander housing;

first and second expander rotors rotatably mounted within said expander housing, said first and second rotors respectively having intermeshing lobes and recesses configured and fitted so that oil-free gas expansion with work output takes place upon rotation of said expander rotors in said expander housing; and means interconnecting said inlet and outlet on said compressor housing and said inlet and said outlet on said expander housing for providing a closed cycle for the circulation of oil-free refrigerant gas therein, for rejecting heat, and for receiving heat for producing cryogenic refrigeration upon rotation of said rotors.

2. The refrigerator system of claim 1 wherein a motor is connected to said compressor to drive said compressor rotors in said compressor housing.

3. A closed cycle cryogenic refrigerator system comprising:

a screw compressor having a housing having inlet and outlet ends, and inlet and an outlet adjacent the ends of said compressor housing;

first and second rotors rotatably mounted within said housing, said first and second rotors respectively having intermeshing lobes and recesses configured and fitted so that compression occurs between said rotors and said housing in oil-free gas passing through said compressor, a motor connected to said compressor to drive said compressor rotors in said compressor housing, said first and second compressor rotors being respectively mounted on shafts, said shafts extending exteriorly of said compressor housing, first and second gears respectively mounted on said first and second shafts exteriorly of said compressor housing, said first and second gears interengaging so that said first and second compressor rotors are maintained in the predetermined angular relationship;

an expander having an expander housing having inlet and outlet ends, an inlet adjacent one end of said expander housing and an outlet adjacent the other end of said expander housing;

first and second expander rotors rotatably mounted within said expander housing, said first and second rotors respectively having intermeshing lobes and recesses configured and fitted so that oil-free gas expansion takes place between said expander rotors and said expander housing upon rotation of said expander rotors in said expander housing; and means interconnecting said inlet and outlet on said compressor housing and said inlet and said outlet on said expander housing for providing a closed cycle for the circulation of oil-free refrigerant gas therein, for rejecting heat and for receiving heat for producing cryogenic refrigeration upon rotation of said rotors.

4. The refrigerator system of claim 3 wherein said motor is an electric compressor drive motor and power supply means is connected to said compressor drive motor for powering said compressor drive motor; and a device to be refrigerated is thermally connected to said means for producing refrigeration so that said device to be refrigerated is cooled upon operation of said refrigerator system.

5. The refrigerator system of claim 3 wherein said first and second shafts are mounted on bearings to maintain the rotative axes of said rotors positioned within said compressor housing; and lubrication means is provided for lubricating said gears and said bearings.

6. A closed cycle cryogenic refrigeration system comprising:

a screw compressor having a housing having inlet and outlet ends, an inlet and an outlet adjacent the ends of said compressor housing;

first and second rotors rotatably mounted within said housing, said first and second rotors each having intermeshing lobes and recesses configured and fitted so that compression occurs between said rotors and said housing in oil-free gas passing through said compressor, said first and second compressor rotors being respectively mounted on first and second shafts, said first and second shafts being rotatably mounted with respect to said compressor housing, anti-friction bearings interengaged between said shafts and said housing for maintaining the axis of rotation of said rotors within said housing;

means for lubricating said bearings and a seal between said bearings and said compressor housing;

an expander having an expander housing having inlet and outlet ends, an inlet adjacent one end of said expander housing and an outlet on the other end of said expander housing;

first and second expander rotors rotatably mounted within said expander housing, said first and second rotors each having uniform cross section and having intermeshing lobes and recesses configured and fitted so that oil-free gas expansion takes place between said expander rotors and said expander housing upon rotation of said expander rotors in said expander housing; and means interconnecting said inlet and outlet on said compressor housing and said inlet and said outlet on said expander housing for providing a closed cycle for the circulation of oil-free refrigerant gas therein, for rejecting heat, and for receiving heat for producing cryogenic refrigeration upon rotation of said rotors.

7. The refrigerator system of claim 6 wherein seals are positioned around said first and second shafts between said bearings and said rotors so that lubricant is inhibited from passing from said bearings into said compressor housing.

8. The cryogenic refrigerator of claim 1 wherein said seals comprise a portion of each said seal rotating with said shaft and a portion of each said seal fixed with respect to said housing, one of said portions being a magnetic flux path and the other of said portions being a magnet so that when a magnetizable lubricant liquid is used to lubricate said bearing, the magnetizable lubricant liquid is prevented from passing into said compressor housing past said magnetic seal.

9. The refrigerator system of claim 8 wherein a lubricant is used to lubricate said bearings and said lubricant is a mixture of finely divided solid magnetizable material in a viscous liquid lubricant.

10. The refrigerator system of claim 9 wherein said motor is an electric compressor drive motor and power supply means is connected to said compressor drive motor for powering said compressor drive motor; and a device to be refrigerated is thermally connected to said means for producing refrigeration so that said device to be refrigerated is cooled upon operation of said refrigerator system.

11. A closed cycle cryogenic refrigeration system comprising:

a screw compressor having a housing having inlet and outlet ends, an inlet and an outlet adjacent the ends of said compressor housing;

first and second rotors rotatably mounted within said housing, said first and second rotors each having uniform cross section and respectively having intermeshing lobes and recesses configured and fitted so that compression occurs in oil-free gas passing through said compressor;

an expander having an expander housing having inlet and outlet ends, an inlet adjacent one end of said expander housing and an outlet adjacent the other end of said expander housing;

first and second expander rotors rotatably mounted within said expander housing, said first and second rotors each having uniform cross section and respectively having intermeshing lobes and recesses configured and fitted so that oil-free gas expansion takes place upon rotation of said expander rotors in said expander housing;

means interconnecting said expander to said compressor for controlling expander speed and transmitting power therebetween; and means interconnecting said inlet and outlet on said compressor housing and said inlet and said outlet on said expander housing for providing a closed cycle for the circulation of oil-free refrigerant gas therein, for rejecting heat, and for receiving heat for producing cryogenic refrigeration upon rotation of said rotors.

12. The refrigerator system of claim 11 wherein a motor is connected to said compressor to drive said compressor rotors in said compressor housing.

13. The refrigerator system of claim 12 wherein said first and second compressor rotors are respectively mounted on shafts, said shafts extending exteriorly of said compressor housing, first and second gears respectively mounted on said first and second shafts, said first and second gears interengaging so that said first and second compressor rotors are maintained in a predetermined angular relationship.

14. The refrigerator system of claim 13 wherein said first and second shafts are mounted on bearings to maintain the rotative axes of said rotors positioned within said compressor housing; and lubrication means is provided for lubricating said gears and said bearings.

15. The refrigerator system of claim 14 wherein said motor is an electric compressor drive motor and power supply means is connected to said compressor drive motor for powering said compressor drive motor; and a device to be refrigerated is thermally connected to said means for producing refrigeration so that said device to be refrigerated is cooled upon operation of said refrigerator system.

16. A cryogenic refrigeration system comprising:

a compressor, said compressor having a housing and having first and second rotors rotatably mounted in said housing, said first and second rotors each having a uniform cross section and respectively having lobes and recesses configured and fitted so that as said rotors rotate in said housing said lobes and recesses interengage with each other and cooperate with said housing to compress oil-free gas therein, a compressor inlet port adjacent one end of said housing and a compressor outlet port adjacent the other end of said housing so that oil-free refrigerant gas can be taken in said inlet port to be compressed and discharged from said outlet port;

an expander, said expander comprising a housing and first and second rotors rotatably mounted in said housing, said first and second rotors each having a uniform cross section and respectively having lobes and recesses thereon, said rotors being configured and fitted and interengaging with each other and cooperating with said housing so that when said rotors rotate in said housing oil-free gas is expanded in said expander housing, an expander inlet adjacent one end of said expander housing and an expander outlet adjacent the other end of said expander housing, said compressor inlet and outlet being connected with said expander inlet and outlet, to means for receiving heat and means for rejecting heat in a closed cycle cryogenic refrigeration system so that when oil-free refrigerant gas is in said refrigeration system and said rotors are rotated cryogenic refrigeration is produced at said means for receiving heat; and interconnection means between one of said compressor rotors and one of said expander rotors so that said expander rotors rotate at an angular velocity related to the angular velocity of said compressor rotors to regulate expander speed.

17. The refrigerator system of claim 16 further including drive means for driving said compressor; and a refrigeration load thermally connected to said expander outlet so that said refrigeration load delivers heat to the gas in said refrigeration system so that said refrigeration load is cooled.

18. The refrigerator system of claim 16 wherein said first and second compressor rotors have a gear coupling therebetween so as to regulate relative angular position of said first and second compressor rotors.

19. The refrigerator system of claim 16 wherein said expander rotors have a gear interconnection therebetween so that said first and second expander rotors rotate at a predetermined relative angular velocity.

20. The refrigerator system of claim 19 wherein said first and second compressor rotors have a gear coupling therebetween so as to regulate relative angular position of said first and second compressor rotors.

21. The refrigerator system of claim 16 wherein said first compressor rotor is positively coupled to said first expander rotor so that said first compressor rotor and said first expander rotator operate at a fixed angular rotation rate ratio.

22. The refrigerator system of claim 21 further including drive means for driving said compressor; and a refrigeration load thermally connected to said expander outlet so that said refrigeration load delivers heat to the gas in said refrigeration system so that said refrigeration load is cooled.

23. The refrigerator system of claim 16 wherein there is means for rotatively interconnecting at least one of said compressor rotors and one of said expander rotors for controlling expander speed and transmitting power between said at least one compressor rotor and said at least one expander rotor.

24. The refrigerator of claim 23 wherein said first compressor rotor and said first expander rotor are axially aligned and are rotationally positively coupled.

25. The refrigerator of claim 16 wherein said first and second compressor rotors are in a chamber in said compressor housing and said first and second expander rotors are in a chamber in said expander housing, each of said rotors being mounted on a shaft, a bearing interengaged between each of said sheets and the respective housing, said bearings being positioned exteriorly of said chambers.

26. The refrigerator system of claim 25 wherein a seal is positioned between the bearing on each said shaft and the corresponding chamber.

27. The refrigerator system of claim 26 wherein said seals have means for providing a magnetic field therein, and lubrication means is provided for said bearings for lubricating said berings with a lubricant fluid having magnetizable properties so that each said magnetic seal prevents the magnetizable lubricant from entering said chambers.

28. The refrigerator system of claim 27 further including drive means for driving said compressor; and a refrigeration load thermally connected to said expander outlet so that said refrigeration load delivers heat to the gas in said refrigeration system so that said refrigeration load is cooled.

29. The refrigerator of claim 16 wherein said outlet of said compressor is connected to means for rejecting heat from refrigerant gas, and said means is connected to a counterflow heat exchanger and said counterflow heat exchanger is connected to deliver gas to the inlet of said expander, said expander outlet being connected to means for receiving heat from a refrigeration load for cooling the refrigeration load, and said means for receiving heat being connected through said counterflow heat exchanger to said compressor inlet so that a closed cycle gas refrigeration system is achieved.

30. The refrigerator of claim 29 further including a device to be refrigerated, said device to be refrigerated being thermally connected to said means for receiving heat from a refrigeration load; and an electric motor is connected to said compressor to drive said compressor and an electric power supply is connected to said compressor motor to energize said compressor motor.

* * * * *